US007080791B2

(12) United States Patent
Geissele et al.

(10) Patent No.: US 7,080,791 B2
(45) Date of Patent: Jul. 25, 2006

(54) ABRASION ASSEMBLY FOR SUPPORTING RAILROAD TIES

(75) Inventors: William Hugo Geissele, Waterford Works, NJ (US); Frank Howard Coats, Thorofare, NJ (US)

(73) Assignee: Pandrol Limited, Addlestone (GB)

( * ) Notice: Subject to any disclaimer, the term of this patent is extended or adjusted under 35 U.S.C. 154(b) by 6 days.

(21) Appl. No.: 10/652,011

(22) Filed: Aug. 29, 2003

(65) Prior Publication Data

US 2004/0113133 A1 Jun. 17, 2004

Related U.S. Application Data

(60) Provisional application No. 60/430,560, filed on Dec. 3, 2002.

(51) Int. Cl.
*E01B 9/38* (2006.01)

(52) U.S. Cl. ..... 238/264; 238/306

(58) Field of Classification Search ..... 238/264, 238/283, 285, 306, 382
See application file for complete search history.

(56) References Cited

U.S. PATENT DOCUMENTS 3,311,331 A * 3/1967 Steimen ..... 248/633
4,047,663 A * 9/1977 Reynolds et al. ..... 238/304
4,316,578 A * 2/1982 Reynolds et al. ..... 238/283
4,648,554 A * 3/1987 McQueen ..... 238/283
5,330,165 A * 7/1994 van Goubergen ..... 267/141

* cited by examiner

*Primary Examiner*—S. Joseph Morano
*Assistant Examiner*—Robert J. McCarry, Jr.
(74) *Attorney, Agent, or Firm*—Gottlieb, Rackman & Reisman, P.C.

(57) ABSTRACT

An assembly for supporting a railroad rail on a tie includes an abrasion plate arranged to be positioned on a tie, and a pad disposed on the abrasion plate and adapted to receive the rail. The pad and plate have mating depressions and buttons arranged in complementary patterns that provides means of interlocking the two components to resist migration in both longitudinal and lateral directions. Preferably the depressions are larger than the buttons to allow some play. The two elements may be attached to each other prior to transportation by a combination of a projection on one and a capturing hole in the other. The projection may be a stake having an enlarged head. The plate may be secured to the tie by an epoxy and may have irregularities on the bottom to be gripped by the epoxy. A seal may also be provided around the supports for the rail clips to keep sand and other extraneous matter from the interface between the plate and the tie. The seal may be provided on the plate or the pad.

20 Claims, 7 Drawing Sheets

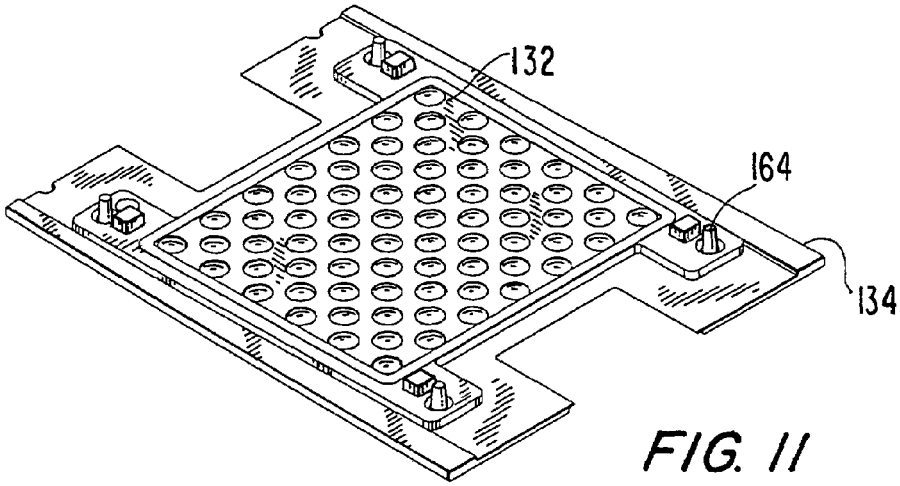
FIG. 11
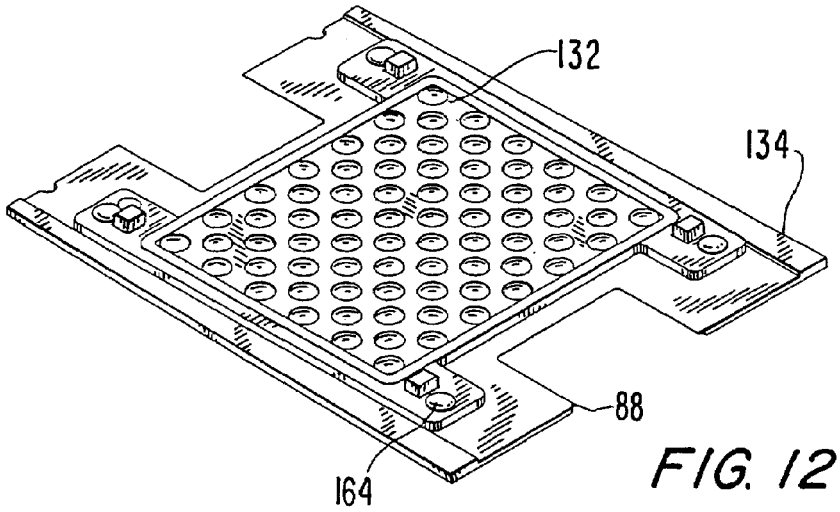
FIG. 12
FIG. 13
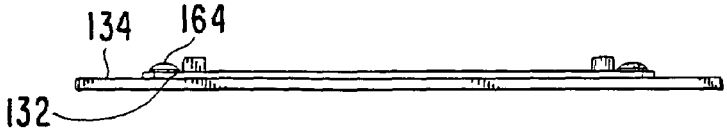

ABRASION ASSEMBLY FOR SUPPORTING RAILROAD TIES

RELATED APPLICATIONS

This application claims priority to provisional application Ser. No. 60/430,560 filed Dec. 3, 2002 and incorporated herein by reference.

BACKGROUND OF THE INVENTION

1. Field of Invention

This invention pertains to a novel abrasion assembly, and more particularly, to a abrasion assembly formed of an abrasion plate resting on the railroad tie and a pad on the plate and supporting the rail. More specifically, means are provided to interlock the abrasion plate and the pad to resist being separated by the shifting of the rail laterally or longitudinally, and to lock the abrasion plate to the tie for shipping. Means are also provided to seal the underside of the plate from contaminate egress.

2. Description of the Prior Art

During the last decades, the old wooden ties used to support railroad rails were replaced by concrete ties and pads were provided between the rails and the concrete ties. These pads provided two functions: they acted as shock absorbers for the rails and they provided electrical insulation. This latter function is important for railroad systems in which the rails form a part of the electrical circuitry for either the motive power, signaling or control functions. Separate rail clips or other similar fasteners are used to clamp the rail to the ties. For example, commonly owned U.S. Pat. No. 5,110,046, incorporated herein by reference, discloses a two part abrasion assembly: an elastomeric pad and an abrasion plate resting on the tie. The abrasion plate was made of a heat treated high carbon steel. The abrasion plate was provided on its bottom surface with a layer of adhesive to secure it to the concrete tie. Other abrasion assemblies have been developed with an abrasion plate made of a plastic material.

However, problems still remain with abrasion assemblies. One problem is that, after excessive use, the concrete tie under the assembly gets worn and has to be repaired. A further problem is that over time rails tend to expand and contract longitudinally due to temperature changes, as a result of train movement and tie maintenance. This action tends to separate the two parts of the assembly.

OBJECTIVES AND SUMMARY OF THE INVENTION

It is an objective of the present invention to provide a method of repairing worn railroad ties.

A further objective is to provide an improved abrasion assembly supported on the ties, said abrasion assembly being constructed of two parts: an erosion plate disposed on the tile and a pad disposed on the plate and supporting the rail.

A further objective is to provide an improved two-part abrasion assembly with means to prevent, or at least resist, forces a pad disposed under the rail to resist separation between the two parts.

Other objectives and advantages of the inventions shall become apparent from the following description.

A known two-part abrasion assembly consists of a sandwich of two layers, namely, a metallic abrasion plate and a plastic rail pad. The components of such a abrasion assembly conventionally are pre-assembled before it is transported to the track site for installation on a new concrete sleeper. Each such sandwich is held together by fiberglass tape that is strapped around the two assembled components for the purpose of preventing them from coming apart during transit. Such a tape is, however, difficult and slow to apply so as to ensure that the abrasion assembly will not come apart inadvertently.

Briefly, in order to eliminate the use of fiberglass tape and instead thereof to afford an easier and more economical attachment arrangement for the plastic abrasion plate and the rail pad of the 2-part abrasion assembly of the present invention, it is contemplated to utilize a "heat stake" feature. The basic design of this feature is a protruding plastic post which is provided on one of the components of the assembly and is dimensioned to fit through a corresponding hole in the other component. In the preferred form of the present invention, since the rail pad rests on the abrasion plate, the post which constitutes the "heat stake" is provided on and as a part of the abrasion plate and the hole is formed in the rail pad (but the arrangement could just as well be the reverse), such that in the assembled state an end portion of the post extends from the hole. When it is desired to attach the two components to each other, the protruding end of the post is pressed with a hot surface, for example, such as the tip of a soldering iron. The hot surface serves to melt the protruding end region of the post to a width greater than that of the hole, by virtue of which the post is prevented from being withdrawn from the hole and the two components are permanently attached to each other. Each paired abrasion plate and rail pad may, of course, be provided with more than one post and one hole, as the case may be.

A unique feature of the "heat stake" of the present invention is the large amount of clearance incorporated into the post and hole fit. It would be understandable if one were to desire to smash the melted post into the hole so as to form them into a single joint held tightly together; that, however, would be a mistake. The rail pad and the abrasion plate should not be assembled tightly together because the rail pad must be free to locate itself around the sidepost insulator. Therefore, the "heat stake" of the present invention is so implemented that there will be a large annular clearance between the post and the hole. The post-melting process will be carefully controlled so that a "mushroom" head is formed on the protruding end region of the post which will block any withdrawal of the post through the hole but will not hinder the rail pad and the abrasion plate from moving freely in relationship to each other within the constraints of the annular clearance between the post and the hole.

Another problem addressed by the present invention relates to insufficient longitudinal restraint of the rail. A contributing factor to low longitudinal restraint was thought to be the lack of a positive mechanical lock between the abrasion plate and the rail pad. It will be understood that as the rail moves longitudinally under operational, environmental or maintenance conditions, it tries to drag the rail pad along. The corresponding movement of the rail pad had previously been restrained by a combination of arrangements, such as protruding ears that fit around the shoulders, rectangular upstands that engage the side post insulator, and surface finish modifiers designed into the rail abrasion assembly.

The interlocking mechanism of the present invention consists of a pattern of male protrusions on the top face of the abrasion plate and a corresponding pattern of female recesses or depressions on the bottom face of the rail pad. The interlocking features are designed with clearance at initial assembly and positioning. This allows the rail pad and the abrasion plate to take up their corresponding positions in the rail seat region with respect to the differing positions of the shoulders and the side post insulators.

The present interlocking feature also affords an additional method of restraining the abrasion plate. As the pad moves longitudinally relative to the abrasion plate, the clearance between the male protrusions and the female depressions is decreased until contact occurs. The multiple points of contact positively lock the abrasion plate and the rail pad together, thereby increasing longitudinal restraint.

The present invention also provides another solution to the problem of reducing the ingress of sand and small debris into the interface space between the abrasion plate and the rail seat area of the concrete sleeper. This solution was based on the consideration that the small gap between each side of the abrasion plate and the respective proximate cast shoulder acts as a pocket to trap abrasive contaminates that would eventually find their way under the abrasion plate. These particles trapped between the two surfaces would add to abrasive wear of both the concrete sleeper at the rail seat and the overlying abrasion plate.

The mentioned additional solution to this problem is the provision of a positive interference fit from the abrasion plate to the cast shoulders. The dimensional tolerances of the cast shoulders, or sleeves, the dimensional tolerances of the positioning of the cast shoulders on the sleeper, and the dimensional tolerances of the abrasion plate all combine to effectively preclude the achievement of a close precise fit between the abrasion plate and the cast shoulders. Instead of a manufactured close fit, therefore, the solution contemplated by the present invention is to have a thin, flexible protrusion or lip added to each side of the abrasion plate adjacent to the proximate cast shoulder. The lips are designed to interfere with the respective shoulders to the extent of about 0.015". As the abrasion plate is slipped onto the rail seat and between the shoulders, these thin lips abut against the shoulders and deflect to precisely cover the gaps between the sides of the abrasion plate and the respective shoulders, thereby to seal out the contaminates. The interference fit between these lips and the shoulders also serves to lock the assembly onto the tie for shipping purposes thereby making double sided tape or adhesives to attach the assembly to the tie unnecessary. This arrangement is useful when ties and, the rail clip retaining shoulders or sleeves, and abrasion assembly or assembled in one location and then shipped together to the field.

BRIEF DESCRIPTION OF THE DRAWING

FIG. 11 shows an isometric view of the plate of FIGS. 9 and 10 with a juxtaposed pad, during assembly; and FIG. 12 shows an isometric view of the completed abrasion assembly of FIG. 11; and FIG. 13 shows a side elevational view of the abrasion assembly of FIG. 12.

DETAILED DESCRIPTION OF THE INVENTION

Figure 1:
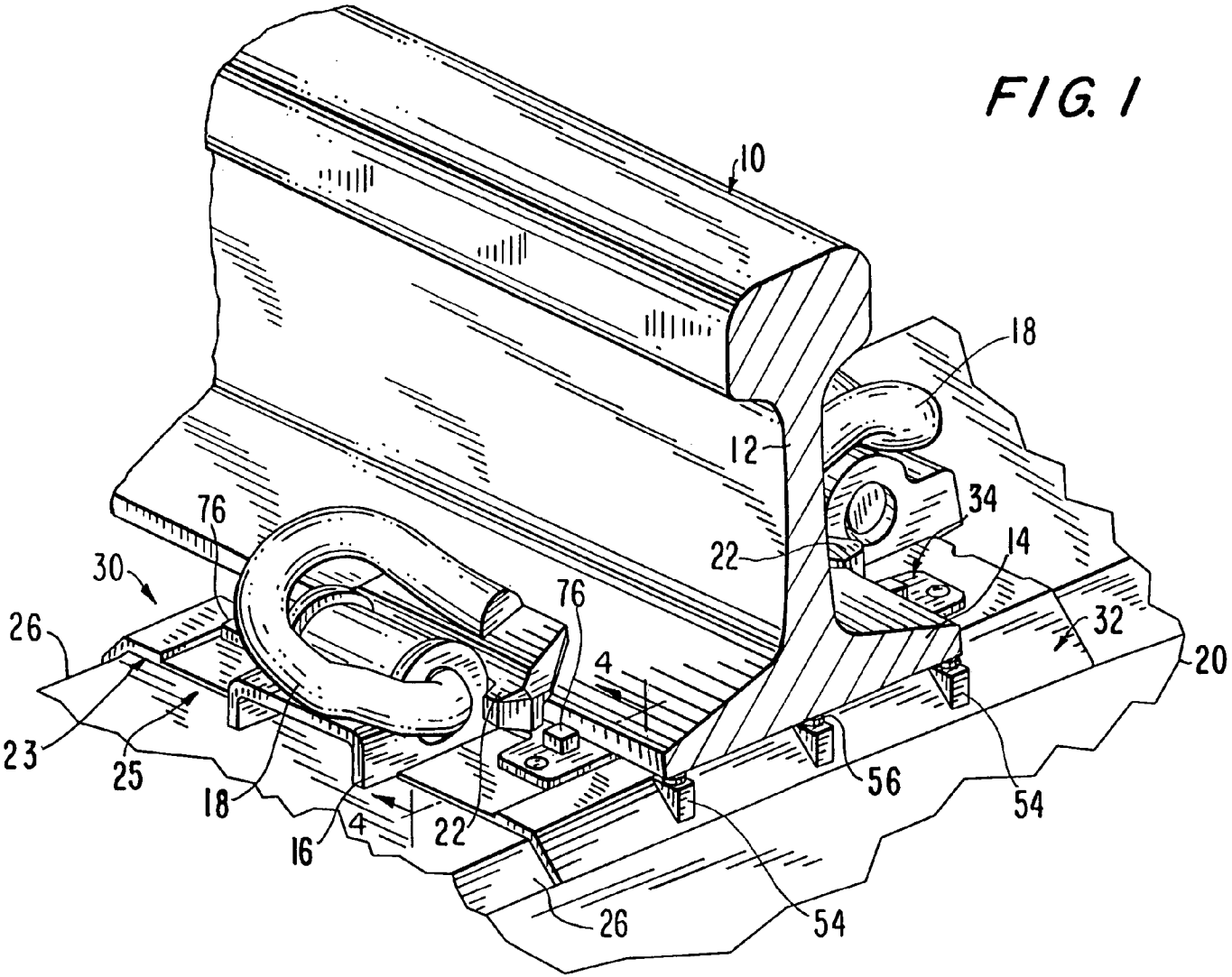
FIG. 1 shows an isometric view of a rail supported by a abrasion assembly and a concrete tie in accordance with this invention.
Figure 2:
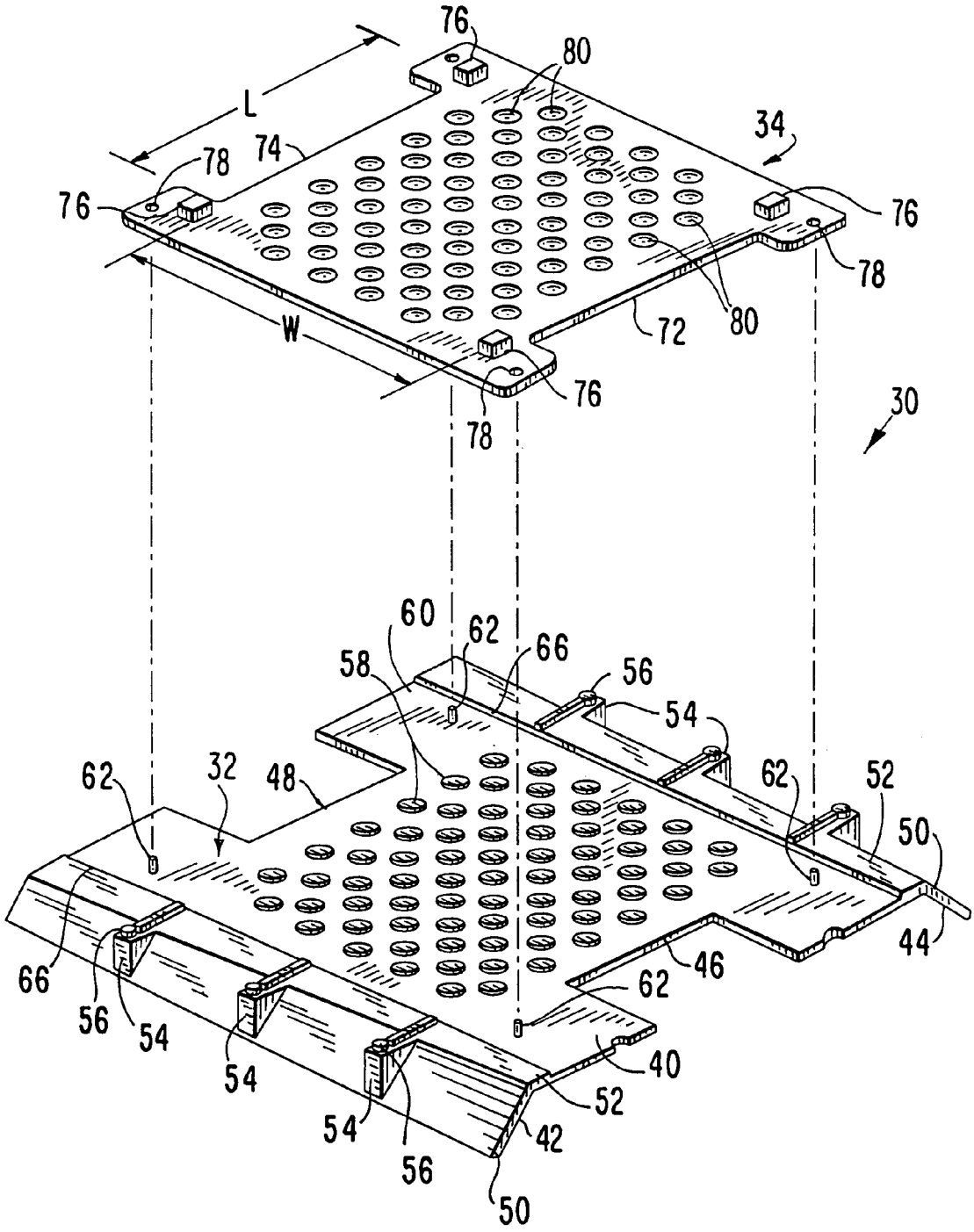
FIG. 2 shows an isometric exploded view of the two parts making up the abrasion assembly.
Figure 3:
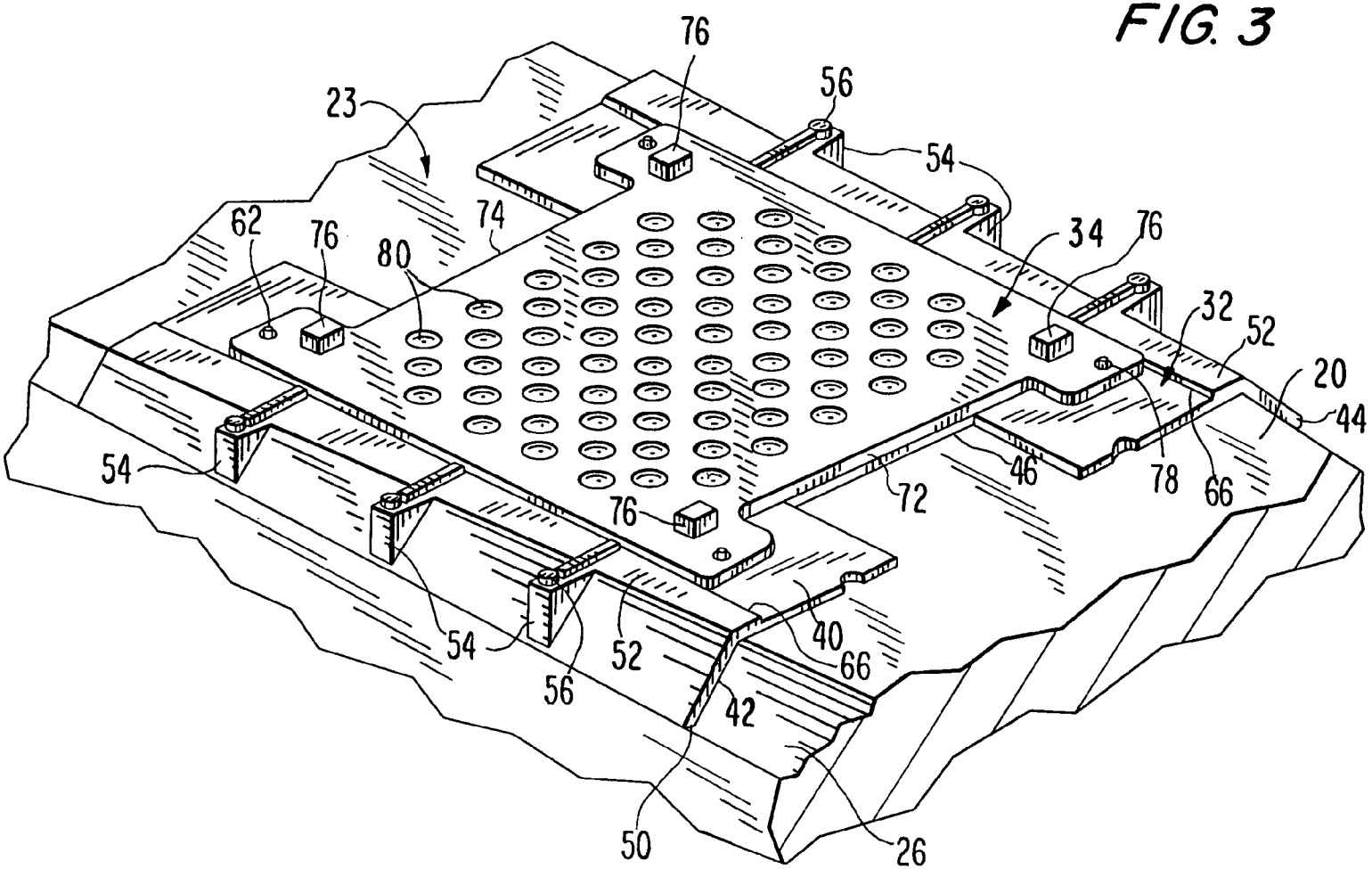
FIG. 3 shows the two parts of the abrasion assembly permanently joined together.

FIG. 1 shows a standard rail 10 with a web 12 and a flange 14 and is supported on a concrete tie 20 by a two-part abrasion assembly 30. A sleeve 16 is attached to an anchor (not shown) that is imbedded in the tie 20. The sleeve 16 engages and supports a steel clip 18. Other clip supports may be used as well. The clip presses down on a wedge 22 which pushes down on the flange 14. In this manner, the abrasion assembly 30 is sandwiched between the rail flange 14 and the tie 20. The abrasion assembly includes an erosion plate 32 and a pad 34 described in more details below, As mentioned above, one problem with existing assemblies and ties is that, over time, the surface of the tie 20 disposed under the abrasion assembly 30 is worn away by sand, and other foreign matter, causing a large indentation. Because of this indentation, the abrasion assembly becomes loose and is no longer able to perform its function properly.

According to this invention, this condition is repaired as follows. First, the clips 18 are removed from the sleeve 16 and are disengaged from the wedges 22 to free the rail 10. This process is termed declipping in the art. Next, the rail 10 is raised and then the old abrasion assembly is removed from underneath the tie 20. Next, a suitable epoxy mixture 25 is applied to the top surface 23 of the tie 20 in the region of the worn surface and a new abrasion assembly 30 is immediately placed onto the still semi-liquid epoxy mixture 25 covering the surface 23, Soon afterward, the rail 10 is lowered back onto the abrasion assembly 30 and the uncured epoxy 25. Under the load of the rail 10, the uncured epoxy mixture 25 is squished out to fill in, and subsequently to cure with an irregular undersurface filling the worn portion of surface 23. The top portion of epoxy 25 is cured to form a planar upper surface laying flat against the underside of the abrasion assembly 30, and more particularly to the lower surface 33 of the abrasion plate 32. The cured epoxy forms a filler which has just the right shape to fill in the irregular gap between the bottom surface of the erosion plate 32 and the worn top surface 23, and form a physical lock between the abrasion plate and the tie.

Some commercially available materials that may be used is an epoxy available form R-Solutions of Denver, Colo. under the name of Concrete Tie Epoxy, but other materials may be suitable as well.

Details of several embodiments of the improved abrasion assembly 30 are now described in conjunction with FIGS. 2–9. It should be understood that abrasion assembly 30 can be applied on a tie with or without a worn surface 23. The abrasion plate 32 is made of a high impact plastic material such as polypropylene and has a generally H-shaped outline with a flat portion 40 and may incorporate two transversal sides 42 and 44 (the terms transversal and longitudinal are used herein with reference the longitudinal axis of rail 10).

The flat section 40 is formed with two rectangular cutouts 46 and 48 designed to wrap around the sleeves 16, as seen in FIG. 1. The side 42 is formed with a flat portion 52 and a slanted portion 50. The slanted portion 50 is designed to match the slanted wall 26 of the tie. The side 44 has the same shape and size as the portion 42. The distance between the two sides 42 and 44 is selected so that the erosion plate 32 seats completely on the tie 20 with the flat section 40 and flat portions 52 are in substantially continuous contact with the top surface 23 (when the surface is not worn) with the slanted portions 50 being in substantial contact with the slanted walls 26. Alternatively, the slanted portions may be dimensioned to form a slight clearance with the slanted walls 26.

The sides 44 are provided with three standoff posts 54. While the remainder of the abrasion plate 32 is solid, these standoff posts 54 are hollow to save weight and material. The tops of the posts may be formed with buttons 56. As seen in FIG. 1, the buttons have the same thickness as the pad 34. The buttons 56 may be omitted.

Figure 4A:
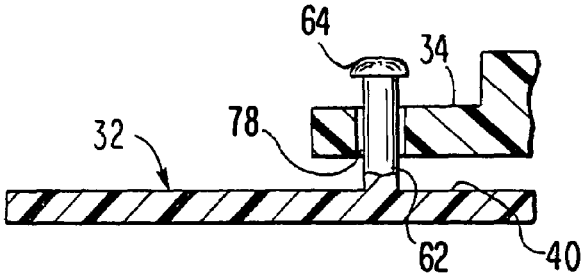
FIGS. 4A and 4B shows a partial cross sectional view of abrasion assembly in the storage/transport and installed configuration respectively with details of the stakes and their distorted heads, taken along lines 4—4in FIG. 3.

The flat section 40 is formed with a pattern of protrusions 58 on its top surface 60 which shall be discussed in more detail below. At the four corners of top surface 60, the flat section 40 is also provided with coupling stalks 62. As shown in FIG. 4A, each stalk terminates with a mushroom shaped head 64.

At the interface between the flat section 40 and the transversal sides 42, 44 a shoulder 66 is formed by making the transversal sides 42, 44 thicker than the section 40. This shoulder provides an additional means of increasing the longitudinal restraint and securing the rail pad to the abrasion plate such that pad extrusion and deformation decreases.

The rail pad 34 is now described in conjunction with FIGS. 2, 3, 4A and 4B. It has a generally H-shaped body having a substantially uniform thickness. As with abrasion plate 32, the pad 34 has two cutouts 72, 74 placed substantially in the same position as the cutouts 46, 48 so that when the plate 32 and 34 are coupled to each other, these cutouts partially surround the sleeves 26.

At its four corners, the pad 34 has four generally square bosses 76 extending upwardly. The transversal distance W between the bosses 76 is equal to or slightly wider than the width of the rail 10. The longitudinal distance L between the bosses is slightly larger then the longitudinal length of wedge 22.

In addition, the pad 34 has four holes 78, each hole matching the position of a respective coupling stalk 62, a first set of circular dimples 80 on its top surface and a second set of circular dimples 82 on its bottom surface. The two sets of dimples 80, 82 have the same size dimples but the dimples 80 are laterally offset and do not fall exactly the top dimples 80. The dimples need not be circular but could have other shapes as well.

As mentioned above, conventionally a rail pad and the corresponding abrasion plate are taped together and therefore difficult to separate in the field. The storage/transport configuration is shown in FIG. 4A. In this configuration, as the name implies, the pad and the plate are kept together so that they can be stored or transported. The plate 32 and pad 34 are manufactured separately (e.g., by molding), with the stalks 62 being formed without the mushroom head 64. Once these elements are completed, the pad is superimposed over the pad 32 and they are pressed together causing the tips of the stalks 62 to enter through holes 78 on the pad 32. The tips are then deformed into heads 64 using a hot cup-shaped element. The heads 64 have a larger diameter than the holes 78 so that, once the heads are formed, the stalks 62 are captured, and the pad is coupled to and cannot be separated from the plate without breaking the stalks (See FIG. 4A). Preferably, the head 64 is offset slightly vertically from the pad, and the holes 78 are larger then the diameter of the stalks 62. These features allow some movement between the pad and the plate that is beneficial while the abrasion assembly is installed.

Figure 4B:
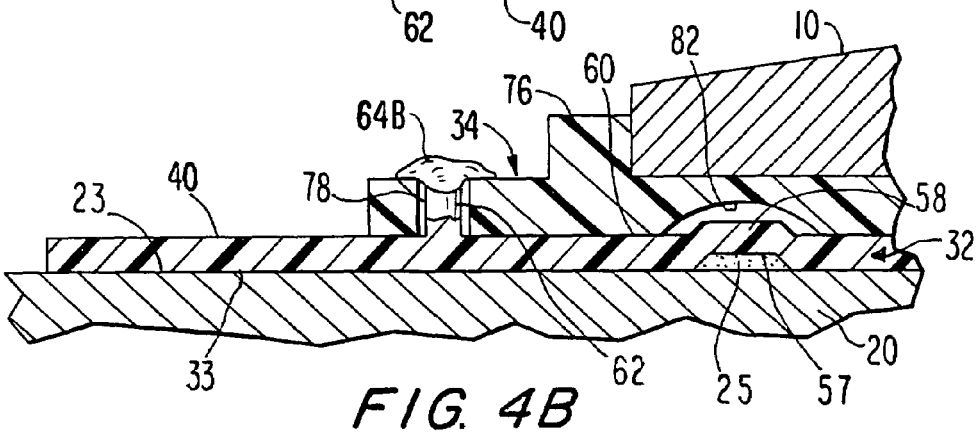

In an alternate embodiment, the stalks 62 and holes 78 have matching dimensions and do not allow any movement between the plate and the pad. In this embodiment, the stalk can be formed with a head 64B that is closer to the surface of the pad is collapsed around the mouth of the respective holes 78, as shown in FIG. 4B.

Figure 5:
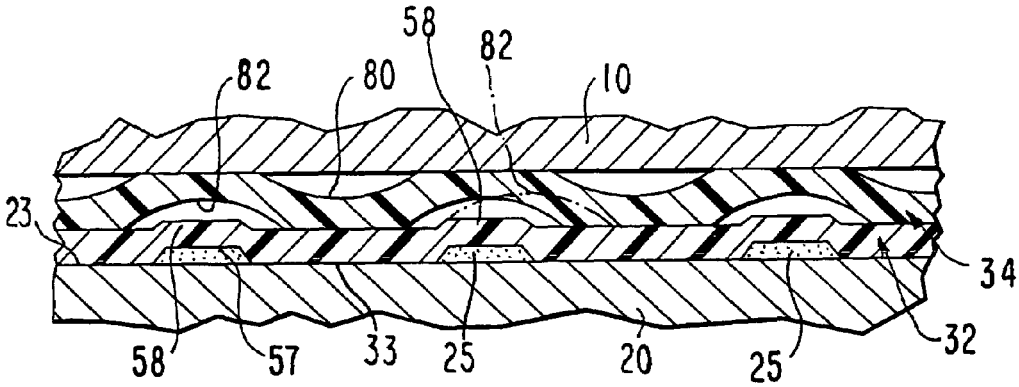
FIG. 5 shows an enlarged cross sectional view of the interface between the plate and the pad.

Referring now to FIG. 5, in one embodiment of the invention, the abrasion plate 32 is formed with a plurality of depressions 57 on its bottom surface and a plurality of protrusions 58 on its top surface. The protrusions on the bottom surface trap some of the epoxy mixture 25 and further increase the adhesion between the surface of the tie 12 and the abrasion plate 32.

The rail pad 34 is formed with a plurality of circular depressions 80 on the top surface and a plurality of depressions 82 on the bottom surface. The purpose of depressions 80 is to enable modification of the rail pad spring rate, and its damping characteristics. The depressions 82 are arranged to receive the protrusions 58 as shown. Preferably, the depressions 82 are slightly larger than the protrusions so that before the plate 32 and pad 34 are locked into their final positions, they can be shifted around slightly to accommodate various dimensional tolerances. Importantly, even after the plate and pad are in the installed configuration, if the abrasion assembly is installed, the rail 10 is lowered onto the pad 34 so that it is positioned and captured between the bosses 76. Next, the rail 10 is secured to the tie 20 and abrasion assembly 20 by pins 18 and wedges 22. The wedges are also captured between the bosses 76. The sleeves 16 are captured between the cutouts 46, 48, 72 and 74.

Any slight movement of the rail relative to the abrasion assembly or tie, either longitudinally or transversely, causes the pad 34 to shift in the respective direction slightly, until the edges of the depressions 82 contact the edges of protrusions 58, as shown in phantom in FIG. 5.

Figure 6:
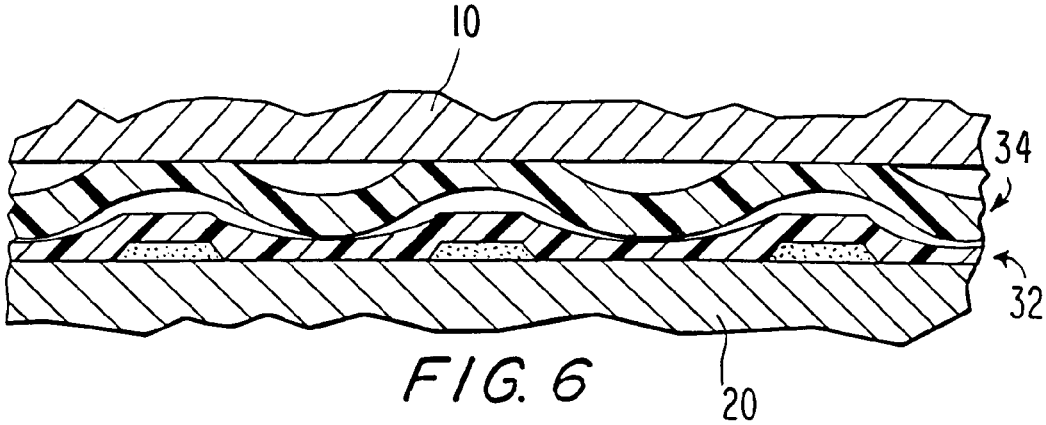
FIG. 6 shows an alternate embodiment wherein the plate and the pad have matching depressions and protrusions with no substantial clearance.
Figure 7:
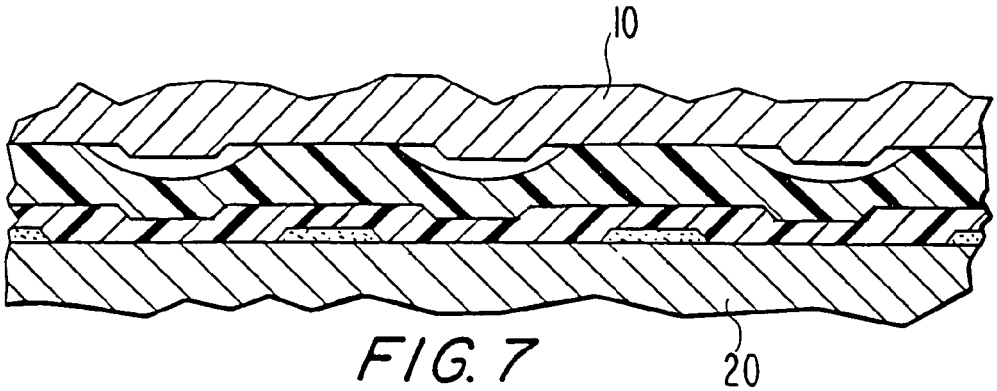
FIG. 7 shows an alternate embodiment wherein the plate is provided with depressions and the pad is provided with matching protrusions.

In other embodiments of the invention, each of the protrusions 58 can be converted into depressions, and each of the depressions can be converted into protrusions (as shown in FIG. 6) to obtain the same result. In another embodiment, shown in FIG.7, the pad and plate have matching protrusions and dimples with virtually no clearance therebetween.

Figure 8:
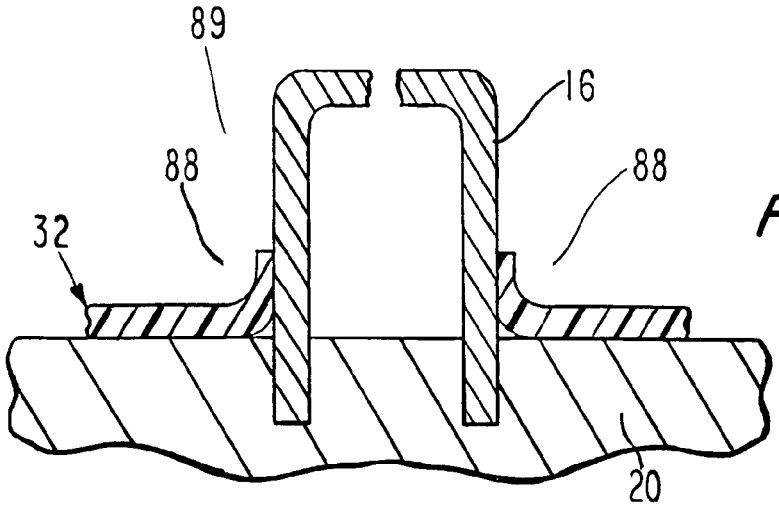
FIG. 8 shows a details of a sealing lip between the plate and the sidewalls of a sleeve.

As discussed above, one pernicious problem with abrasion assemblies has been that sand and other foreign particles get lodged between the plate and the tie and eventually cause indentations in one or both which may compromise the fastening function. It is believed that one source that allows ingress of sand is the spacing between the sleeve 16 (and the supporting anchor-both of which are made of cast ductile iron with relatively large tolerances) and the plate 32. The interface between the sleeve 16 and plate 32 occurs at the periphery of the cut outs 46, 48. Therefore, in one embodiment of the invention, the plate 32 is provided around the cutouts with a thin lip 88. The lip 88 is thin enough so that it is flexible, and can be deflected upwardly with respect to the plane of plate 32. Moreover, the thin lip 88 defines a space that is somewhat smaller than the dimensions of the sleeve 16 and its anchor. Therefore, when the plate 32 is installed in tie 20 and over the sleeve 16, lip 88 is bent upwards, all around each cutout so that its tip bears against the sidewalls or shoulders 89 of the sleeve 16 as shown in FIG. 8 thereby forming a seal around the sleeve 16. This seal insures that sand and other foreign matter is kept away from the interface between the plate 32 and tie 12. In other words, the lip 88 forms an interference fit with the shoulders 89. The width of this lip 88 may be in the order of about 0.020" high (or thick) and may be about 3/16" wide while the plate adjacent to the lip is about 3/16" thick.

Advantageously, because there is an interference fit provided between the abrasion assembly 30 and the clip sleeve 16, it is now possible to assemble in a warehouse a tie with clips sleeves embedded therein and an abrasion assembly disposed between the clip sleeves 16, and then ship these parts together to the installation site.

The abrasion assembly discussed so far is preferably used for existing installations, especially where the tie has been worn away, as discussed above. FIGS. 9–12 show another embodiment of the invention, which is suitable primarily for new installations. However, either embodiment could be used for new and existing installations.

Figure 9:
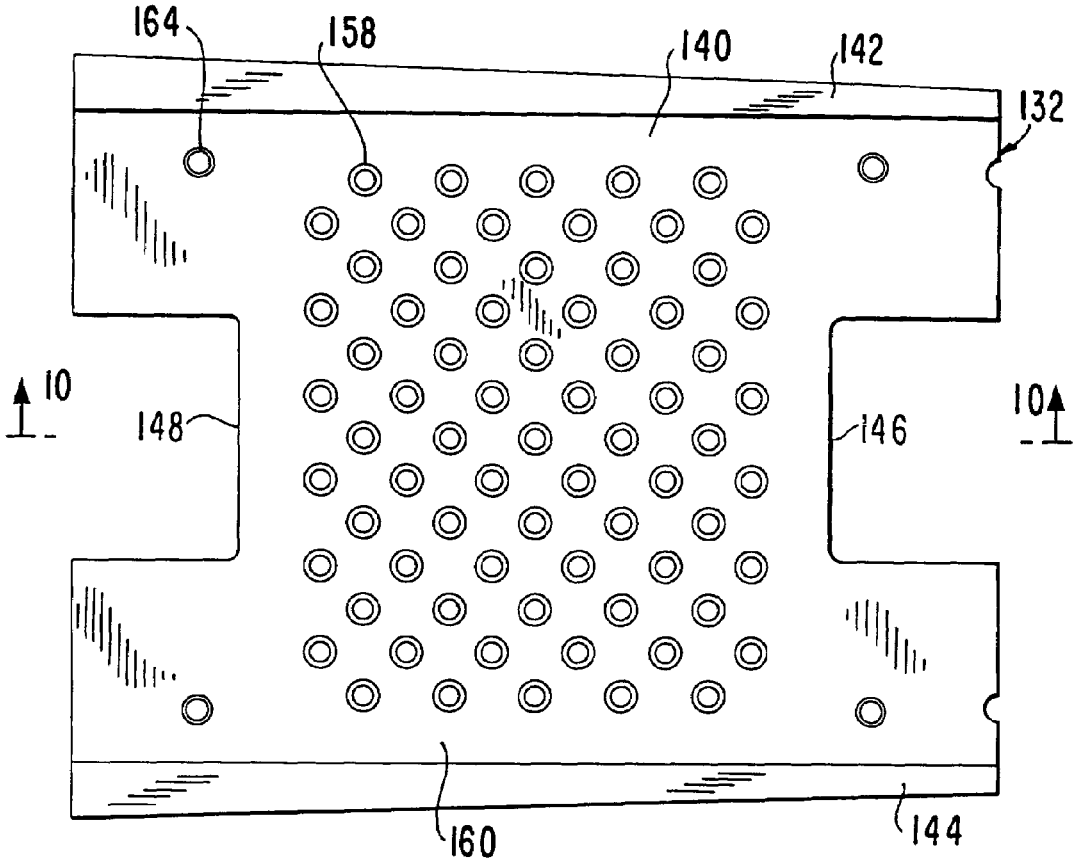
FIG. 9 shows a plan view of an alternate embodiment of the plate.

Referring now to FIG. 9, plate 132 is made of a high impact plastic material such as polypropylene, and has a generally H-shaped outline with a flat recessed portion 140 and two transversal ridges 142 and 144, which are tapered in width to match the shape of standard railroad ties.

The flat section 140 is formed with two rectangular cutouts 146 and 148 performing the same functions as the cutouts 46, 48 in FIG. 1.

Figure 10:
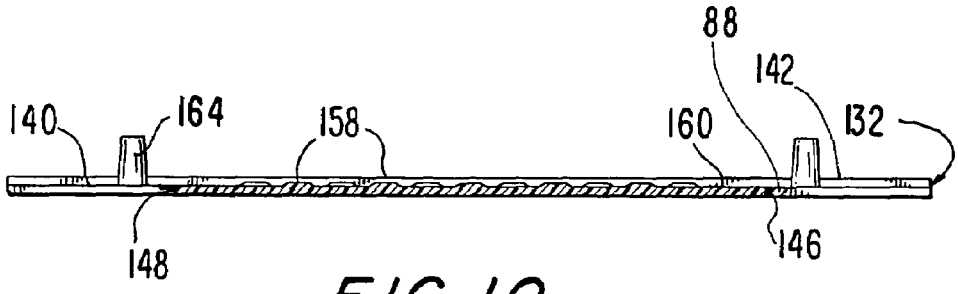
FIG. 10 shows a side elevational view of the plate of FIG. 9.

The flat section 140 is formed with a pattern of protrusions 158 on its top surface 160. The bottom surface of the plate 132 can be made with indentations in the same manner as plate 32, or alternatively, the plate 132 is made with a flat bottom surface, as shown in FIG. 10. At its four corners, section 140 is also provided with coupling stalks 164. The flat section 140 is formed with transversal ridges 142, 144, as an additional method of increasing longitudinal restraint and securing the rail pad to the abrasion plate such that pad extrusion is decreased.

Once the plate 132 and pad 134 are formed using standard molding techniques, the pad 134 is placed over the plate with the stalks 164 extending through the holes in the pad 134 as shown in FIG. 11. The tips of the stalks 164 are then rounded or otherwise deformed to thereby interlock the plate 132 and pad 134 as shown in FIGS. 12 and 13. The pad and plate now form an abrasion assembly that can be stored and shipped efficiently to the railroad installation site. Alternatively, since the plate 132 is also formed with sealing lips (not shown), the abrasion assembly of FIGS. 12 and 13 can also be inserted between the shoulders of two sleeves on a tie prior to shipping.

FIGS. 14A and 14B show an alternate embodiment of a rail pad. This rail pad 234 may mounted on and together with a standard abrasion plate (not shown). The pag has four bosses 276 and a plurality of transversal indentations 290. Along its sides, the pad 234 has two indentations 272, 274 sized to fit around respective sleeves 16 (shown in FIG. 1) or other similar clip support members. Importantly, as best seen in FIG. 14B, the indentations 272, 274 are provided with respective peripheral sealing lips 288. These lips seal the tie under the pad 234 (and the abrasion plate) from sand and other impurities, in a manner similar to the lips 88 discussed above. Similar lips may also be provided on pads 34 and 134. The lips on the pads may be about 3/16" wide and about 0.050" thick while the lad itself is about 1/4" thick.

To summarize, a novel abrasion assembly is disclosed that includes means of securing the abrasion assembly to a concrete tie, securing and coupling the parts of 234 the abrasion assembly together, sealing the abrasion assembly around the sleeves holding the pins, securing the rail to the abrasion assembly, and securing and coupling the abrasion assembly to a tie in a factory or assembly line prior to shipping. These means include the use of epoxy mixture between the plate and the tie, the provision of protrusions or indentations on the bottom surface of the plate, provision of side portions on the plate positioned over the respective inclined walls of the tie, the provision of matting protrusions and dimples or depressions at the interface between the plate and the pad, the provisions of the stakes on the plate and the matching holes in the pad, provision of the heads on the stakes, provision of the bosses on the pad that capture both the rail and the wedges, provision of a sealing lip around critical areas of the sleeve, etc.

While the invention has been described with reference to several particular embodiments, it is to be understood that these embodiments are merely illustrative of the principles of the invention. Accordingly, the embodiments described in particular should be considered as exemplary, not limiting, with respect to the following claims.

We claim:

1. An assembly for supporting a rail on a railroad tie, said assembly comprising:

an abrasion plate having an upper surface, and being constructed and arranged to fit on the railroad tie;

a rail pad having a lower surface and being constructed and arranged to fit on said abrasion plate with said lower surface facing and contacting said upper surface and to support the rail, said raid pad being separate and removable from said abrasion plate; and a locking mechanism adapted to prevent movement between said abrasion plate and said railroad pad, said locking mechanism including a plurality of bumps uniformly distributed on one of said surfaces and a plurality of matching depressions uniformly distributed on the other of said surfaces, said bumps and matching dimensions being provided at least under the rail.

2. The assembly of claim 1 wherein said bumps have dimensions smaller than said depressions to allow relative adjustment there between.

3. The assembly of claim 1 wherein said bumps are formed on said rail pad.

4. The assembly of claim 1 wherein said abrasion plate has a lower surface with additional depressions.

5. The assembly of claim 1 wherein said abrasion plate has a lower surface, and is formed with upper surface and lower surface depressions.

6. The assembly of claim 5 wherein said upper surface depressions are offset laterally from said lower surface depressions.

7. The assembly of claim 1 wherein said abrasion plate includes two opposed plate sides formed to wrap around the tie sides.

8. The assembly of claim 7 wherein said plate sides each include a flat portion and an angled portion.

9. The assembly of claim 1 wherein said depressions and bumps have vertical heights that are smaller than the thicknesses of said plate and said pad.

10. A railroad assembly component for supporting a railroad track on a railroad tie, said component comprising:

an abrasion plate having a generally flat body and adapted for placement on the tie;

a rail pad arranged to be placed on top of said abrasion pad and to support the rail; and a coupling adapted to couple said abrasion plate and said rail pad, said coupling including a projection dependent on one of said abrasion plate and said rail pad, and a hole adapted to receive and capture said projection and formed on the other of said abrasion plate and said rail pad, wherein said projection includes a stalk terminated with a head, said head being bigger than said hole, wherein said stalk has a cross-sectional dimension smaller than the cross-sectional dimension of the hole to allow some lateral play between said plate and said pad.

11. The assembly of claim 10 wherein said projection is integrally formed on and attached to said abrasion plate and said hole is formed in said pad.

12. The assembly of claim 10 wherein said pad and said plate each has four corners, and said coupling includes four projections and four corresponding holes disposed at respective corners of one of said pad and plate.

13. An assembly for supporting a rail on a railroad tie, said assembly comprising:

an abrasion plate having an upper surface, and being constructed and arranged to fit on the railroad tie;

a rail pad having a lower surface and being constructed and arranged to fit on said abrasion plate with said lower surface facing and contacting said upper surface and to support the rail; and a locking mechanism adapted to prevent movement between said abrasion plate and said railroad pad, said locking mechanism including a plurality of bumps disposed on one of said surfaces and a plurality of matching depressions on the other of said surfaces;

wherein said abrasion plate includes two opposed plate sides formed to wrap around the tie sides.

14. The assembly of claim 13 wherein said plate sides each include a flat portion and an angled portion.

15. An assembly for supporting a rail on a railroad tie, said assembly comprising:

an abrasion plate having an upper surface, and being constructed and arranged to fit on the railroad tie;

a rail pad physically separate and removable from said plate, and having a lower surface and being constructed and arranged to fit on said abrasion plate with said lower surface facing and contacting said upper surface and to support the rail; and locking means for preventing lateral movement between said abrasion plate and said railroad pad when a train passes over said rail, wherein said locking mechanism includes a plurality of bumps distributed on one of said surfaces and a plurality of matching depressions distributed on the other of said surfaces, each bump being disposed in a corresponding depression, said bumps and depressions being provided under rail.

16. A railroad assembly component for supporting a railroad track on a railroad tie, said component comprising:

an abrasion plate having a generally flat body and adapted for placement on the tie;

a rail pad separate from said abrasion plot and disposed on top of said abrasion pad to support the rail; and coupling means for coupling said abrasion plate and said rail pad, said coupling including a projection dependent on one of said abrasion plate and said rail pad, and a hole adapted to receive and capture said projection and formed on the other of said abrasion plate and said rail pad, said coupling allowing said plate and pad to move with respect to each other at least laterally without separation.

17. A railroad assembly component for supporting a railroad track on a railroad tie, said component comprising:

an abrasion plate having a generally flat body and adapted for placement on the tie;

a rail pad arranged to be placed on top of said abrasion pad and to support the rail; and a coupling adapted to couple said abrasion plate and said rail pad, said coupling including a projection dependent on one of said abrasion plate and said rail pad, and a hole adapted to receive and capture said projection and formed on the other of said abrasion plate and said rail pad;

wherein said projection includes a stalk terminated with a head, said head being bigger than said hole, said stalk having a cross-sectional dimension smaller than the cross-sectional dimension of the hole to allow some lateral play between said plate and said pad.

18. The assembly of claim 17 wherein said pad and said plate each has four corners, and said coupling includes four projections and four corresponding holes disposed at respective corners of one of said pad and plate.

19. A railroad assembly component for supporting a railroad track on a railroad tie, said component comprising:

an abrasion plate having a generally flat body and adapted for placement on the tie;

a rail pad arranged to be placed on top of said abrasion pad and to support the rail; and coupling means adapted to couple said abrasion plate and said rail pad, said coupling including a projection dependent on one of said abrasion plate and said rail pad, and a hole adapted to receive and capture said projection and formed on the other of said abrasion plate and said rail pad;

wherein said projection includes a stalk terminated with a head, said head being bigger than said hole, said stalk having a cross-sectional dimension smaller than the cross-sectional dimension of the hole to allow some lateral play between said plate and said pad.

20. A railroad assembly component for supporting a railroad track on a railroad tie, said component comprising:

an abrasion plate having a generally flat body and adapted for placement on the tie;

a rail pad arranged to be placed on top of said abrasion pad and to support the rail; and a coupling adapted to couple said abrasion plate and said rail pad, said coupling including a projection dependent on one of said abrasion plate and said rail pad, and a hole adapted to receive and capture said projection and formed on the other of said abrasion plate and said rail pad, wherein said projection includes a stalk terminated with a head, said head being bigger than said hole, wherein said pad and said plate each has four corners, and said coupling includes four projections and four corresponding holes disposed at respective corners of one of said pad and plate.

* * * * *